United States Patent [19]

Reich

[11] Patent Number: 4,995,246

[45] Date of Patent: Feb. 26, 1991

[54] WARP KNITTING MACHINE WITH AT LEAST ONE BAR

[75] Inventor: Ferdinand Reich, Seligenstadt, Fed. Rep. of Germany

[73] Assignee: Karl Mayer Testilmaschinenfabrik GmbH, Fed. Rep. of Germany

[21] Appl. No.: 441,376

[22] Filed: Nov. 27, 1989

[30] Foreign Application Priority Data

Dec. 1, 1988 [DE] Fed. Rep. of Germany ..... 3840531

[51] Int. Cl.[5] ..... D04B 15/20

[52] U.S. Cl. ..... 66/125 R; 66/207; 66/214

[58] Field of Search ..... 66/207-214, 66/114, 125 R; 139/157

[56] References Cited

U.S. PATENT DOCUMENTS

| | | | |
|---|---|---|---|
| 1,969,754 | 8/1934 | Kinsella et al. | 66/207 |
| 1,980,209 | 11/1934 | Kinsella et al. | 66/207 |
| 2,694,302 | 11/1954 | Weinberg | 66/214 |
| 3,584,480 | 6/1971 | Zwingenberger et al. | 66/114 |
| 3,978,691 | 9/1973 | Schmid | 66/208 |
| 4,130,141 | 12/1978 | Alley | 139/157 |

*Primary Examiner*—Werner H. Schroeder
*Assistant Examiner*—John J. Calvert
*Attorney, Agent, or Firm*—Omri M. Behr

[57] ABSTRACT

A warp knitting machine has guide holders, holding arms, and a guide bar assembly. The assembly includes a guide bar made of reinforced synthetic polymeric materials. This guide bar has along substantially its entire length a substantially hollow profile. The guide bar has surrounding walls substantially enclosing the hollow profile. The guide bar includes a first and second segment. The first fastening segment is adapted to be attached to the holding arm. The second fastening segment is adapted to support the guide holders.

18 Claims, 6 Drawing Sheets

WARP KNITTING MACHINE WITH AT LEAST ONE BAR

The present invention is directed to a warp knitting machine having at least one bar which is made of a reinforced material and is connected, via a first fastening location, with holding arms and via a second fastening location, with thread guide holders.

A warp knitting machine of this general type is disclosed in U.S. Pat. No. 2,694,302 (1954). The guide bars illustrated therein can, upon choice, be made of lightweight metals or out of reinforced synthetics. The holding arms are, rigidly affixed to the bar with screws. The thread guide holders are fixed to the bar by means of clamping screws and nuts. In this arrangement the clamping screws grip through vertical slits in the bar that open upwardly. The bar has an L-shaped cross-section, wherein the vertical slits occupy more than half of the total height of the bar. Despite this early suggestion of the use of reinforced synthetics, bars of this type of material have not heretofore seen commercial use. Use has however, been made of extruded bars of magnesium alloys which, while much lighter than steel bars, still have a comparatively high weight in comparison to reinforced synthetics. They also have the disadvantage of having a rather high thermal coefficient of expansion.

The purpose of the present invention is to provide a warp knitting machine of the foregoing type, possessing a commercially viable bar of reinforced synthetic material.

SUMMARY OF THE INVENTION

In accordance with the illustrative embodiments demonstrating features and advantage of the present invention, there is provided a guide bar assembly in a warp knitting machine having guide holders and holding arms. The guide bar assembly has a guide bar made of reinforced synthetic polymeric materials. The guide bar has along substantially its entire length a substantially hollow profile. The guide bar has surrounding walls substantially enclosing the hollow profile. The guide bar includes a first and second fastening segment. The first fastening segment is adapted to be attached to the holding arms. The second fastening segment is adapted to support the guide holders.

An improved guide bar assembly is therefore provided, preferably by employing a bar of partially hollow cross-section with the hollow opening extending the full length of the bar (i.e., the width of the machine). This hollow is surrounded by substantially closed walls. The holding arms and the thread guide units are clamped on two external fastening locations formed unitarily on the hollow-profile bar.

In this construction, the hollow-profile bar is a closed and thus very stable and particularly distortion-resistant. To this end, the bar may be reinforced through its entire length by fibers. The use of the closed, hollow-profile format permits the use of fibers running parallel to the axis of the bar. Also the fibers may run perpendicular to this bar axis or may subtend an angle to each other. The hollow bar can thus provide a higher degree of stiffness. These advantages are not negatively influenced by incorporating the fastening segments, since they could be provided externally of the hollowed sector. The fastening segments are formed unitarily with the hollowed sector. Conventional bars are coupled to holding arms on one side and thread guide holders on the other. The fastening segments thus increase the cross-sectional dimensions in one direction and can therefore further positively influence the stiffness of the device.

It is advantageous if the fastening segments are each provided with at least one pair of clamping surfaces stretching over the full length of the bar. Even if at a later time, only certain segments of the clamping surfaces are utilized, this mode simplifies production of the arrangement.

It is further advantageous if, between the clamping surfaces of such a pair, there is at least one opening formed in the fastening segment for the passage therethrough of a clamping element. Since this opening, which is important for the provision of the clamping force, may be bored at a later time or formed at the time of construction, any damage to reinforcing fibers by the boring has no substantial impact on bar strength.

In particular, the openings can be formed as a row of holes, wherein the cross-section of the holes is substantially that of the cross-section of the clamping element. This leads to a quite minimal weakening of the fastening segment. The stiffness thereof remains intact.

The opening can also be provided by a longitudinal slot, because the slot is external to the main body segment of the bar. The utilization of a longitudinal slot permits a very simple mode of production.

In a preferred embodiment, the first or upper fastening segment is provided with a longitudinal channel, extending across the entire width of the machine, into which at least one threaded element is inserted. Such element interacts with a clamping screw, wherein the outer side of the fastening segment and the corresponding inner side of the longitudinal channel just below it, provide a pair of clamping surfaces. Such a longitudinal channel is readily formed. It serves not only for the reception but also the prevention of rotation of the threaded element. Holding arms or thread guide holders can be held fast and secure on the outer clamping surfaces of the fastening segments.

In an alternate mode, the second or lower fixing segment for the guide holders provides clamping surfaces on mutually opposite and parallel sides thereof, on which a threaded element, cooperating with the clamping screw, can act. The surface of the fastening segment is angled to provide a barrier to prevent the rotation of the threaded element.

In yet a further embodiment, the lower fastening element can be provided with a slot parallel to the clamping surfaces. By tensioning the clamping screw about the slot, the guide holders are held tight in the slot. The threaded elements can be either multiedged nuts or flat strips having at least two threaded openings therein.

In yet another embodiment, the upper fastening element for the holding arms is provided with a dovetailed cross-section onto which the holding arm having a dove-tailed cross-sectional guide, may be attached by means of a substantially horizontal clamping screw running perpendicular to the longitudinal axis of the guide.

It is preferred that the bar is produced as a layered molding. All openings, longitudinal channels, hollow spaces, and the like, can be readily formed by this method.

The bars are suitably manufactured by a process known as "pulltrusion." In this process, there is provided a hollow die having the internal dimensions corresponding to the outer dimensions of the bar. A floating plug with external dimensions corresponding to the hollow profile is positioned inside the die. In the space between the outside surface of the plug and the inside surface of the die, there are fed either fibers, woven fabric or non-woven fabric of the reinforcing material, or combinations thereof. Similarly, the synthetic material is also simultaneously fed through this space. The term "pulltrusion" is derived from the combination of forces in the system. The synthetics are pumped into the input side and the reinforced product is pulled out of the output side.

BRIEF DESCRIPTION OF THE DRAWINGS

The invention may be illustrated by means of the preferred embodiments which are illustrated in the following figures.

DETAILED DESCRIPTION OF THE PREFERRED EMBODIMENTS

Figure 2:
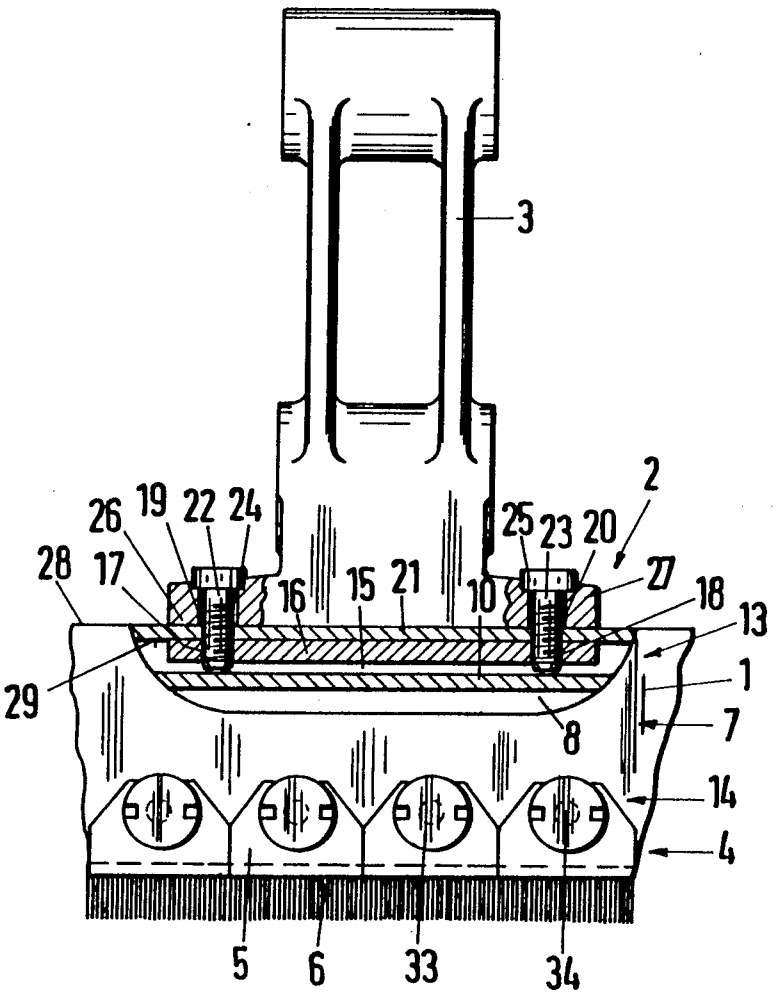
FIG. 2 is a front elevational view with a partial cross-section of a guide bar viewed along lines 2—2 of FIG. 1.
Figure 1:
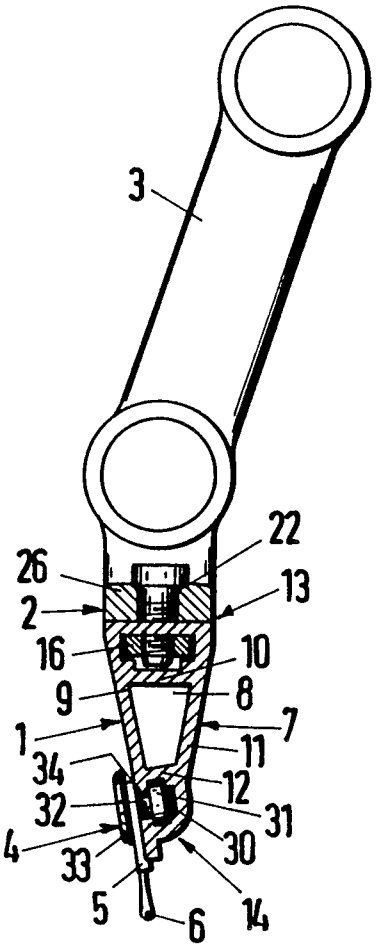
FIG. 1 is a cross-sectional, side elevational view of a guide bar of the present invention.

As illustrated in FIGS. 1 and 2, guide bar 1 is connected to a holding arm 3 via a first upper fastening location 2. Bar 1 carries guide holder 5 via a second lower fastening location 4. Holder 5 carries guides 6.

Guide bar 1, in the preferred embodiment, is constructed of a synthetic composition reinforced by carbon fibers. At its center, bar 1 has a hollow cross-section 7, with hollow space 8 running the length thereof. Space 8 is surrounded by closed walls 9, 10, 11 and 12. Integral therewith is an upper fastening segment 13 and a lower fastening segment 14. Segments 13 and 14 are formed during the formation of said bar.

The upper fastening segment 13 is provided with a longitudinal channel 15. Channel 15 is a hollow running the full length of the bar and defining the inside of a hollow cross-section. A threaded element in the form of a flat strip 16 is laid into channel 15. The strip has screws 22 and 23 with two threaded segments 17 and 18 fitting into two openings 19 and 20 in the uppermost segment 21 of the bar. Screw heads 24 and 25 press flanges 26 and 27 of the holding arm 3 against the upper surface of segment 21. The upper surface of segment 21 thus forms the first clamping surface 28 and its lower surface 29, the second clamping surface.

The lower fastening segment 14 similarly comprises a longitudinal channel 30 which receives four-edged nuts 31 and prevents them from rotating. These nuts operate in conjunction with clamping screws 32, whose heads 33 press guide holders 5 against the outer side of fastening segment 14. Also here, the flat surface flanking the longitudinal channel 30 operates as a first clamping surface and the inner surface of the longitudinal channel 30 proximal thereto provides the second clamping surface. The clamping screws 32 thus grip through openings 34 in the fastening segment 14.

The holes 19 and 20 are only fractionally larger than the cross-section of the clamping screws 22 and 23. The same is true for the cross-section of hole 34 with respect to the cross-section of clamping screw 32. These holes are formed after the production of the bar. Despite the cutting of fibers when these holes are bored, strip 16 together with the foot of holding arm 3 strengthens the bored area to avoid any weakening. Strip 16 in space 15, because of its cross-section, increases the bending strength, wherein the clamping screws 19 and 20 by means of the clamping force, provide the required distribution of the bending tension.

Figure 3:
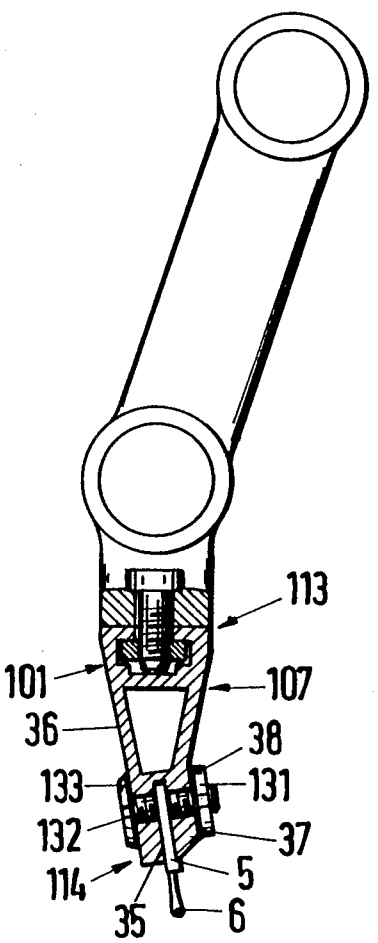
FIG. 3 is a cross-sectional, side elevational view similar of a guide bar that is modification of that of FIG. 1.

In the embodiment illustrated in FIG. 3, parts corresponding to those of FIG. 1 are incremented by 100. Only the lower fastening segment 114 is arranged in a different manner. Here, there is provided a longitudinal slot 35 for the holding guide holders 5. Clamping screw 132 lies with its head 133 against a clamping surface 36 and interacts with a four-edged nut 131 which lies on the other clamping surface 37 on the other side of segment 114. This clamping surface 37 is so oriented as to provide a barrier 38 which prevents rotation of four-edged nut 131.

Figure 5:
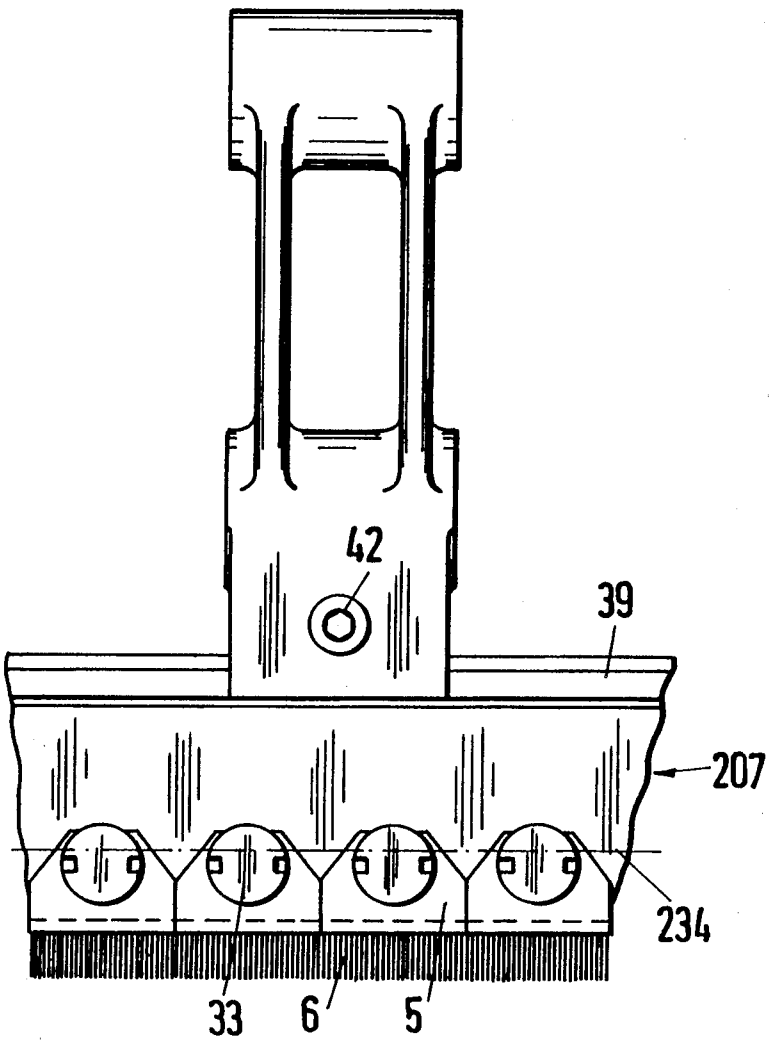
FIG. 5 is a front elevational view with partial cross-section of the guide bar taken along lines 5—5 of FIG. 4.
Figure 4:
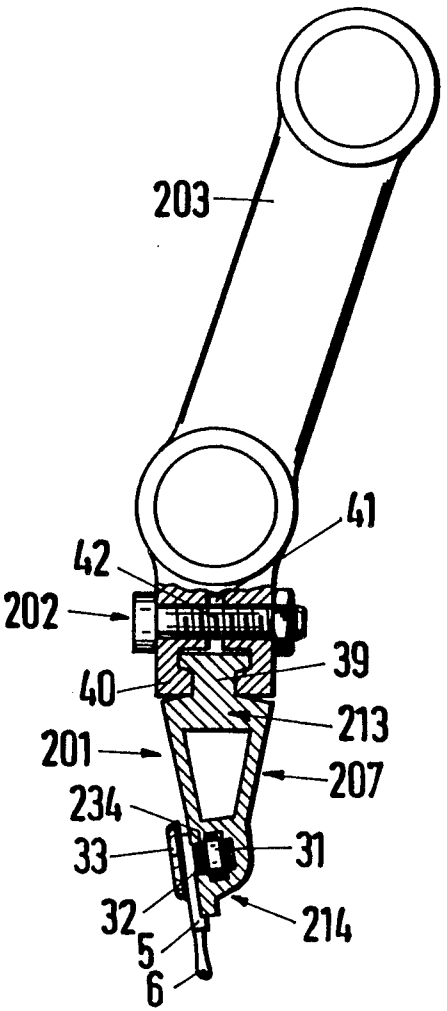
FIG. 4 is a cross-sectional, side elevational view of yet another modification of the embodiment of FIG. 1.

In the embodiments of FIGS. 4 and 5, parts corresponding to those of FIG. 1 are incremented by 200. Bar 201 is illustrated having a lower fastening segment 214 similar to that of FIGS. 1 and 2. However, in place of individual openings 34, there is provided a longitudinal slot 234 through which the clamping screws 32 may pass.

There is a further difference in the first fastening location 202. Bar 201 at fastening segment 213 has a rib segment 39 of dove-tailed cross-section. This interacts with a dove-tailed guide 40 located in holding arm 203. Arm 203 is provided at the lower end thereof with a slot 41. In the vicinity of the slot, the portions of guide 40 can be drawn together by means of clamping screw 42 passing through guide 40 and securing onto nut 43 to provide a safe fastening thereof.

Figure 6:
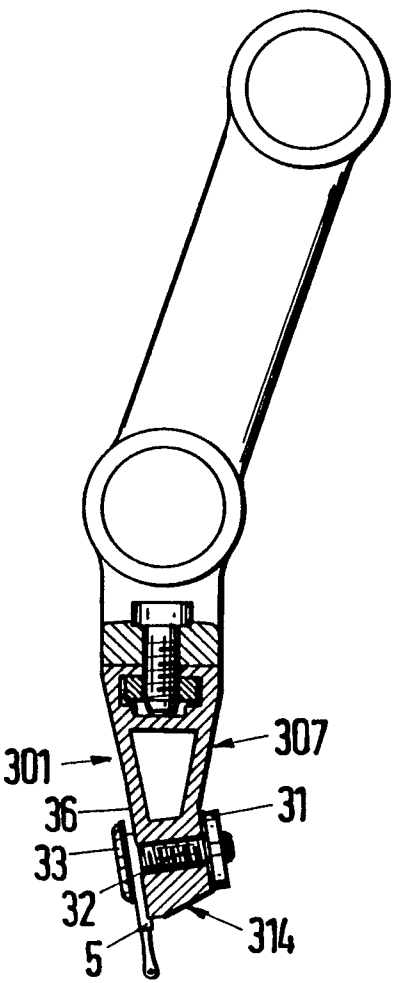
FIG. 6 is a cross-sectional, side elevational view of a fourth modification of the bar of FIG. 1.

In the embodiment of FIG. 6, again the corresponding parts are incremented, this time by 300. Herein there is provided a bar 301 which is identical to that illustrated in FIG. 3. The lower fastening segment 314 lacks, however, a slit, such as slit 35. In this embodiment, guide holders 5 are clamped by head 33 of clamping screw 32 directly against the clamping surface 36 when these are pulled together by interaction with four-edged nut 31.

Figure 7:
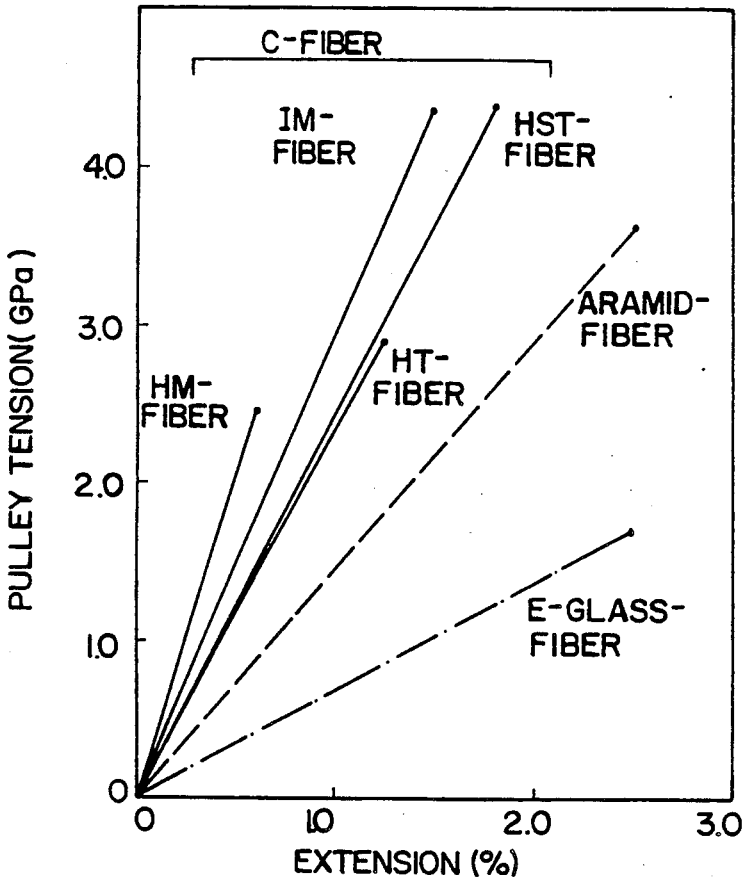
FIG. 7 is a tension/extension diagram for different fibers.

FIG. 7 illustrates the tension/extension diagram for different types of fibers.

Figure 11:
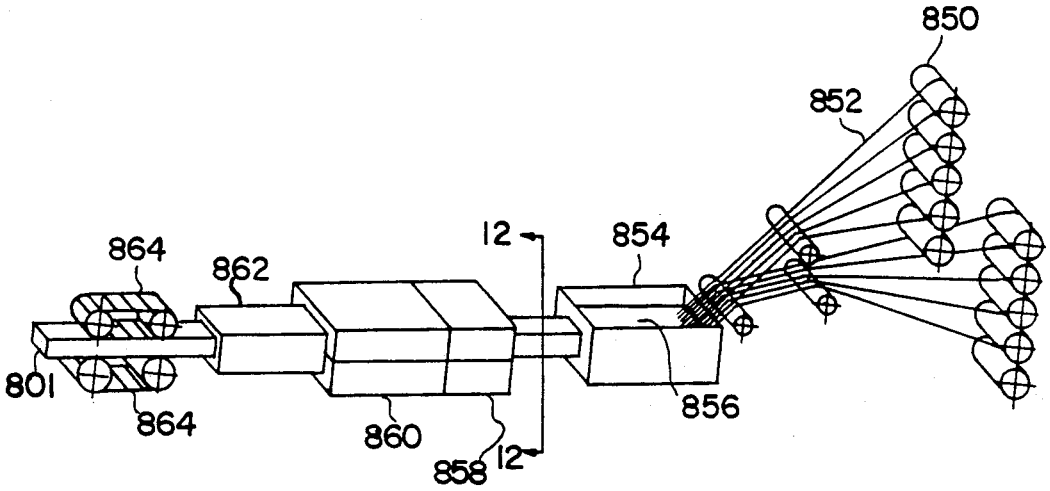
FIG. 11 is a schematic view of a pulltrusion apparatus.

The apparatus for producing bar 801 is schematically illustrated in FIG. 11, which shows the embodiment of the manufacturing process wherein reinforcing fibers are utilized. The apparatus comprises a creel carrying roving spools 850 from which are drawn the fibers 852. These fibers pass through coating bath 856 containing the synthetic material to be cured. From the bath 856 fibers 852 pass into preform 858 and the curing segment 860, which usually contains a heating element, to cooling sector 862. Extraction rollers 864 extract the finished bar 801.

The choice of synthetic polymeric material is also broad, the cured polymer however being thermosetting. Suitable polymers include unsaturated polyesters such as phenyl, isophthalic and vinyl; phenolic resins, epoxy resins and polyimide resins. It is desirable that the fiber/resin ratio be about 50–60:50–40% v/v. It is particularly advantageous if the bar is produced from a carbon fiber composition. This gives an extremely light product of density 1.45 kg./dm.$^3$. The temperature coefficient of expansion is negligibly small so that even at higher operating temperatures, there is substantially no longitudinal expansion.

Figure 12:
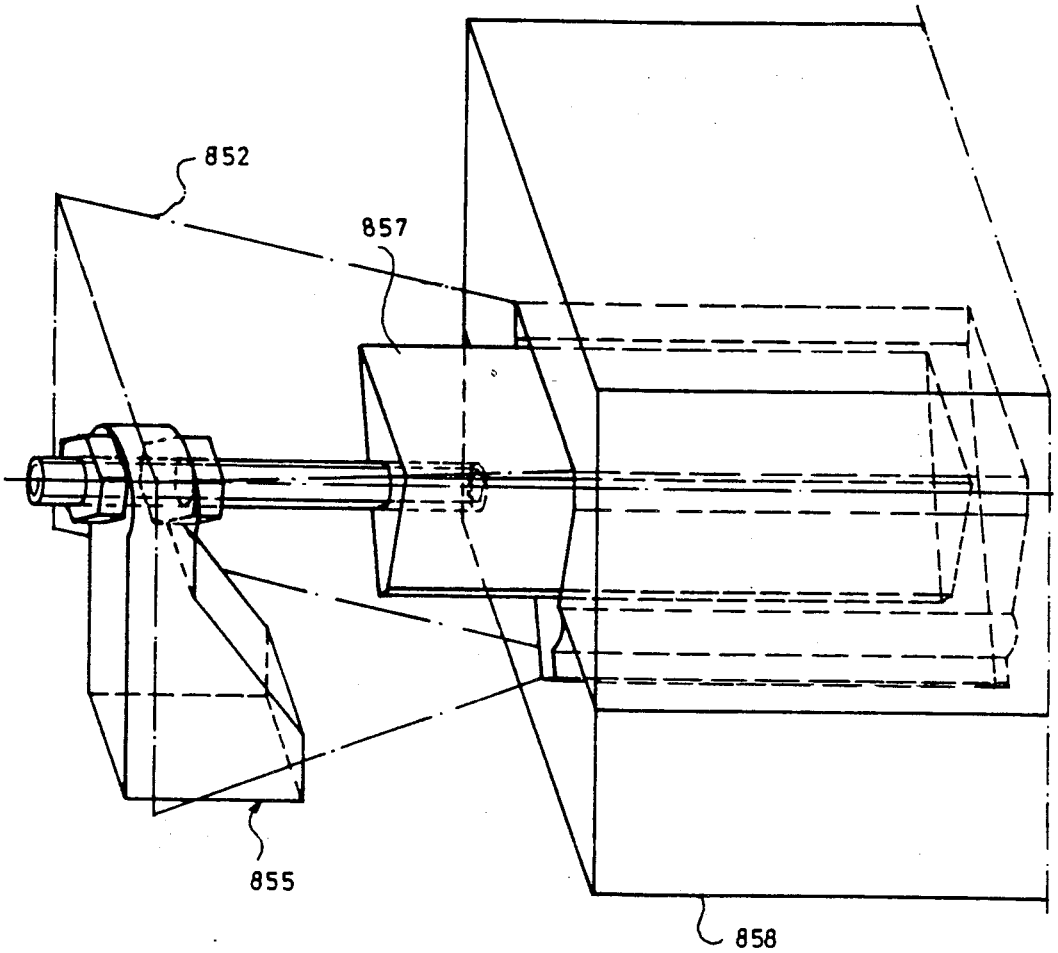
FIG. 12 is a perspective, partial cross-sectional view of the apparatus of FIG. 11 viewed along lines 12—12 of FIG. 11.

The placement of the floating plug is illustrated in FIG. 12, which represents the view along line 12—12, showing how plug 857 is held by plug holder 855 in preform 858 and how the threads 852 pass around plug 857. Holder 855 is an upright stanchion having a horizontal bore. Plug 857 is a wedge-like prism having an upstream rod bolted into the bore of stanchion 855. In other embodiments the outline of plug 857 and the opening in preform 858 can be altered to produce a guide bar of various cross-sections.

Figure 8:
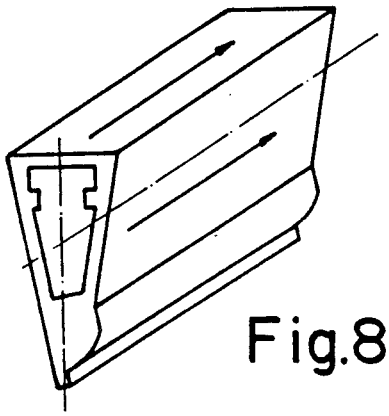
FIG. 8 is a perspective, partial cross-sectional view of a fifth embodiment of a bar showing fibers oriented parallel to the longitudinal axis only.
Figure 9:
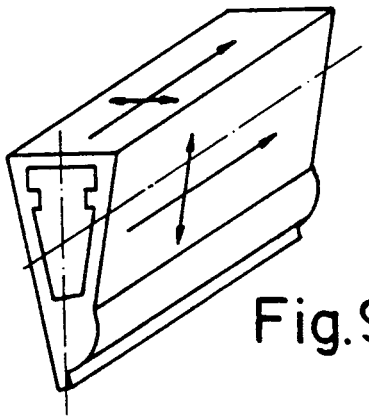
FIG. 9 is a perspective, partial cross-sectional view of the bar of FIG. 8, modified to show fibers oriented parallel and perpendicular to the longitudinal axis of the bar.
Figure 10:
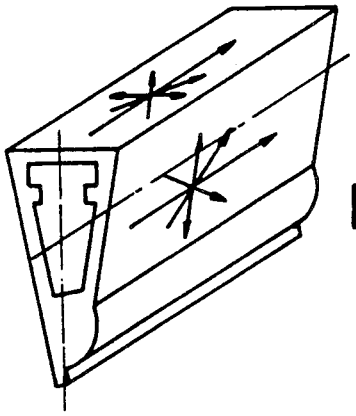
FIG. 10 is a perspective partial cross-sectional view of the bar showing fibers oriented parallel and perpendicular to the longitudinal axis of the bar and at 45° to the previous two directions.
Figure 13:
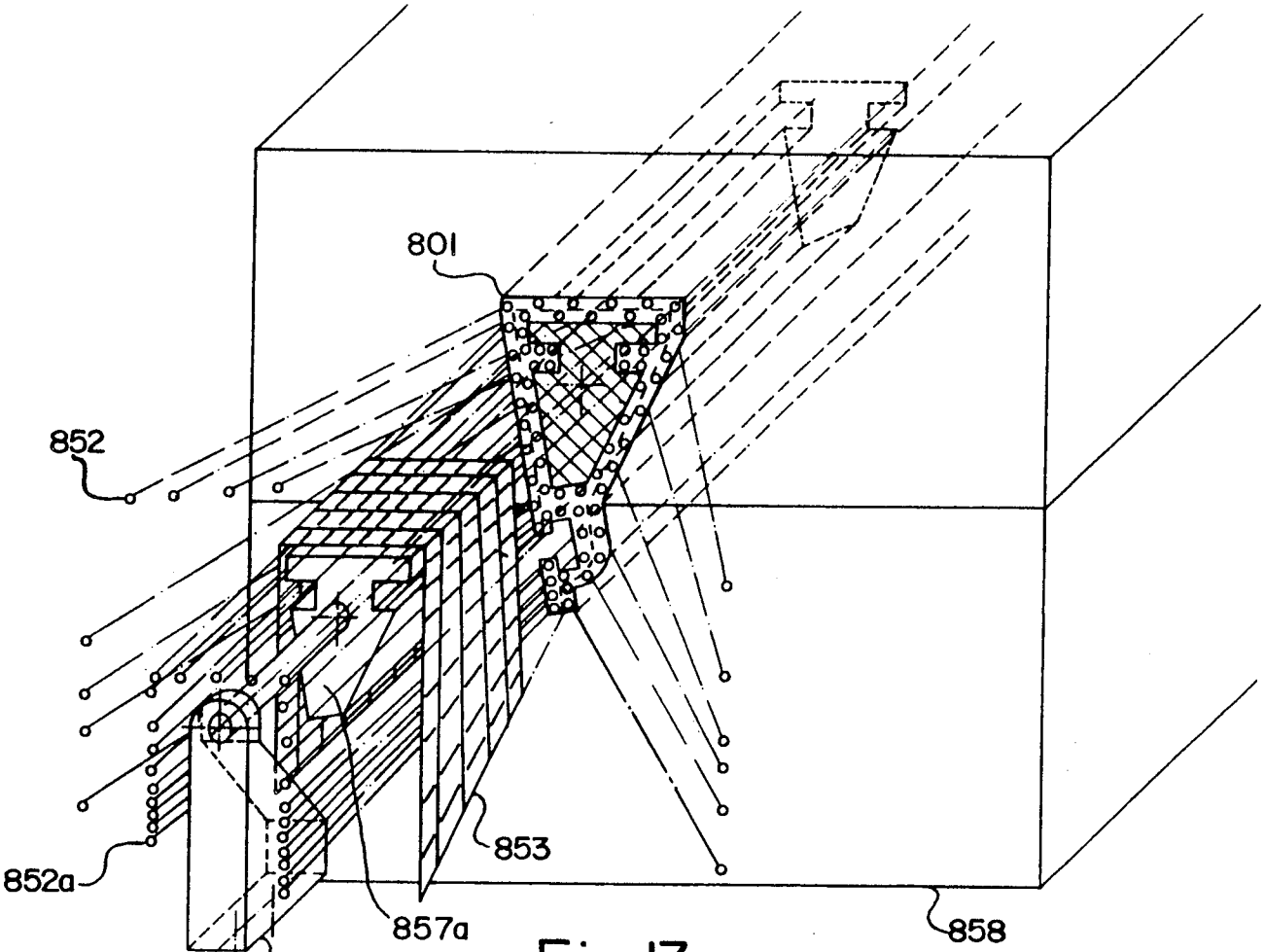
FIG. 13 is another perspective view of the apparatus of FIG. 12.

This sector is illustrated in yet further detail in FIG. 13, which shows not modified plug 857A. Plug 857A has two opposing, rectangular notches to produces shelves in the guide bar as illustrated in FIGS. 8–10. Again plug 857A is held by plug holder 855. Web 853 and fibers 852 and 852A are laid around the plug 857 with fibers 852 lying on the outside of said web 853 and fibers 852A on the inside of said web. The placement of said fibers in said web within bar 801 is also shown. Web 853 can be laid, in a saddle-like shape around the plug 857. Web 853 is closed on itself to enclose plug 857 in preform 858. Web 853 thereby becomes a laminate for reinforcing the guide bar.

The fibers utilized may be any non-metallic fibers. Glass, carbon and aramide are especially suitable. The fibers may be in the form of filaments, woven or nonwoven mats. The woven goods may be woven in any desired orientation. It is preferred that such mats are laid across the plug in such a manner that two edges of the mats meet at the bottom of the bar.

In Table I, there are illustrated various properties of various synthetic materials that are utilizable for the formation of the bars.

TABLE I

| | DUROMER RESIN SYSTEM | | | | | | |
|---|---|---|---|---|---|---|---|
| | Unsaturated Polyester | | | Epoxyresin | | | |
| | Phenyl | Isophthl | Vinyl | Phnolc | Phenyl | MY720 | Plyimid |
| Resin Mg/m$^3$ Density | 1.10–1.46 | 1.23 | 1.15 | 1.30–1.33 | 1.15–1.35 | 1.15–1.25 | 1.35–1.45 |
| Tension MPa Resistance | 35–92 | 53 | 73 | 42–63 | 40–140 | 85 | 75 |
| Bending MPa Resistance | 80–150 | 103 | 132 | 77–120 | 60–180 | 80 | 100 |
| Compress MPa Resistance | 90–180 | | 127 | 85–105 | 10–200 | | 170 |
| Tension GPa Modulus | 1.5–2.0 | 3.7 | 3.5 | 2.8–3.5 | 3.0–5.0 | 3.3 | |
| Tensile % Limits | 2.0–4.0 | 1.25 | 3.0–4.0 | 1.5–2.0 | 0.5–1.0 | 4.0–7.0 | 1.0–7.0 |
| Thermal $\times 10^{-6}$/K Coefficient Of Expansion | | | 53 | | | 70 | |

I claim:

1. In a warp knitting machine having guide holders and holding arms, a guide bar assembly comprising a guide bar made of reinforced synthetic polymeric materials, said guide bar having along substantially its entire length a substantially hollow profile, said guide bar having surrounding a plurality of walls substantially enclosing said hollow profile, said guide bar comprising:

a first fastening segment adapted to be attached to said holding arms; and a second fastening segment adapted to support said guide holders.

2. In a warp knitting machine according to claim 1, wherein each of said first and second fastening segments of the bar comprises at least a pair of clamping surfaces extending over the full length of the bar.

3. In a warp knitting machine according to claim 1, wherein an opposing pair of said walls each have a shelf extending the length of said guide bar.

4. In a warp knitting machine according to claim 3, wherein said guide bar assembly comprises at least one clamping element, the shelves of the opposing pair of said walls being coplanar, said guide bar assembly comprising:

at least one threaded element mounted on said shelves and adapted to threadably engage said clamping element, said pair of clamping surfaces being formed by an inside and proximal outside surface of one of the walls between said opposing pair.

5. In a warp knitting machine in accordance with claim 2, wherein said guide bar assembly comprises at least one clamping element, said pair of clamping surfaces for at least one of said first and second fastening segments having between them at least one integral opening adapted for passing said clamping element.

6. In a warp knitting machine in accordance with claim 5, wherein the opening is formed as a row of openings sized to receive said clamping element.

7. In a warp knitting machine in accordance with claim 5, wherein the opening is formed as a longitudinal slot.

8. In a warp knitting machine in accordance with claim 5, wherein said clamping element comprises a threaded screw, at least one of said first and second fastening segments having a longitudinal channel extending along the full length of the bar, said guide bar assembly comprising:

at least one threaded element mounted in said channel and adapted to threadably engage said clamping element, said pair of clamping surfaces being formed by an inside and proximal outside surface of the longitudinal channel.

9. In a warp knitting machine in accordance with claim 5, wherein said clamping element comprises a threaded screw, the first fastening segment having a longitudinal channel extending along the full length of the bar, said guide bar assembly comprising:

at least one threaded element mounted in said channel and adapted to engage said clamping element, said pair of clamping surfaces for said first fastening segment being formed by: the outside of the first fastening segment, and at a position proximal thereto the interior of the longitudinal channel.

10. In a warp knitting machine in accordance with claim 5, wherein said clamping element comprises a threaded screw, the second fastening segment having a longitudinal channel extending along the full length of the bar, said guide bar assembly comprising:

at least one threaded element mounted in said channel and adapted to engage said clamping element, said pair of clamping surfaces for said second fastening segment being formed by: the outside of the second fastening segment, and at a position proximal thereto the interior of the longitudinal channel.

11. In a warp knitting machine in accordance with claim 1, wherein the second fastening segment for the guide holders has a parallel pair of opposing clamping surfaces, said guide bar assembly comprising:

a clamping screw;

a threaded element threaded onto said clamping screw and engaging one of said clamping surfaces, the other one of said surfaces being engaged by said clamping screw; and a rotation blocking means near said threaded element for preventing rotation of the threaded element.

12. In a warp knitting machine in accordance with claim 10, wherein the second fastening segment has parallel to its clamping surfaces a slot adapted for insertion therein of the guide holders.

13. In a warp knitting machine according to claim 8, wherein the threaded element is a multi-edged nut.

14. In a warp knitting machine according to claim 10, wherein the threaded element is a multi-edged nut.

15. In a warp knitting machine in accordance with claim 8, wherein the threaded element is a flat strip with at least two threaded borings therein.

16. In a warp knitting machine in accordance with claim 10, wherein the threaded element is a flat strip with at least two threaded borings therein.

17. In a warp knitting machine in accordance with claim 1, wherein the first fastening segment for the holding arm has a dove-tailed cross-section, said holding arm having a corresponding dove-tailed cross-sectional guide slot, said guide bar assembly comprising a clamping element passing perpendicularly through said first fastening segment and said holding arm to clamp them together.

18. In a warp knitting machine in accordance with claim 1, wherein said guide bar is made of a composition containing carbon fibers.

* * * * *